US005201807A

United States Patent [19]

Liljenberg et al.

[11] Patent Number: 5,201,807

[45] Date of Patent: Apr. 13, 1993

[54] GAS-FIRED WATER HEATER

[75] Inventors: Gary W. Liljenberg, Brooklyn; Richard K. Nelson, Brecksville; John E. Schmidt, Sr., Cleveland, all of Ohio

[73] Assignee: Gas Research Institute, Chicago, Ill.

[21] Appl. No.: 842,071

[22] Filed: Feb. 26, 1992

[51] Int. Cl.[5] ..... F22B 5/02

[52] U.S. Cl. ..... 122/18; 122/14; 122/367.3; 431/328

[58] Field of Search ..... 122/14, 18, 367.3; 431/328, 329

[56] References Cited

U.S. PATENT DOCUMENTS

| | | | |
|---|---|---|---|
| 3,160,145 | 12/1964 | Miller | 122/367 |
| 3,242,910 | 3/1966 | Hale | 122/265 |
| 4,473,034 | 9/1984 | Raudabaugh et al. | 122/367.3 |
| 4,510,890 | 4/1985 | Cowan | 122/17 |
| 4,644,904 | 2/1987 | Metz | 122/13 R |
| 4,737,102 | 4/1988 | Jinno et al. | 431/328 |
| 4,751,897 | 6/1988 | Malhere et al. | 122/19 |
| 4,793,800 | 12/1988 | Vallett et al. | 122/18 X |
| 4,953,511 | 9/1990 | Boah et al. | 122/18 |

*Primary Examiner*—Edward G. Favors

*Attorney, Agent, or Firm*—Pearne, Gordon, McCoy & Granger

[57] ABSTRACT

A gas-fired booster water heater for providing water at the sanitizing temperature to a commercial dishwashing machine includes an outer housing which is sized to be installed below a counter and contains a burner comprising a burner box and combustion chamber separated by an infrared burner combustion surface facing into the combustion chamber. A heat exchanger includes finned tubes disposed in the combustion chamber for continuous circulation therethrough of water to be heated during heater operation. The heater housing includes an access opening through which the burner box together with the combustion surface may be disconnected from the combustion chamber and withdrawn as a unit for service or repair without removal of the heater from its installed position below the counter.

28 Claims, 5 Drawing Sheets

Fig. 2
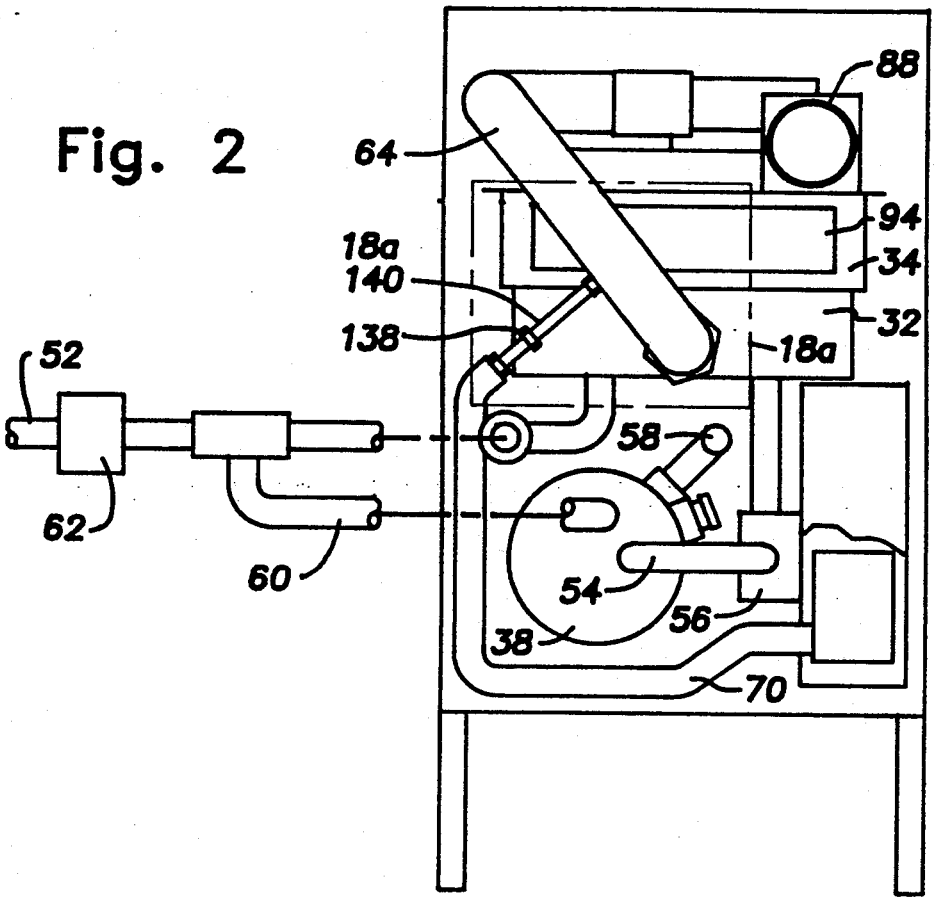
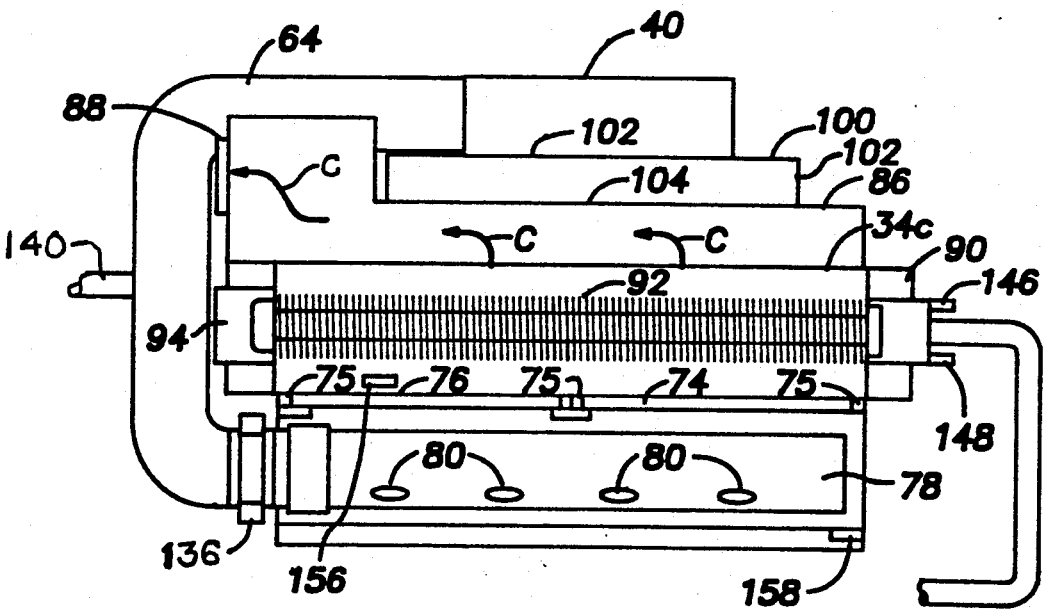
Fig. 3

GAS-FIRED WATER HEATER

BACKGROUND OF THE INVENTION

The present invention relates to combustion heaters, and in particular, to gas-fired water heaters useful as booster heaters for supplying hot water to commercial washing apparatus.

RELATED ART

Commercial washing apparatus such as conveyor, door model or hood model warewashing or dishwashing machines operate during most of the machine operation with hot water at temperatures in the range of 110° to 160° F. as provided by a central or primary water heater or by recycle from a final rinse or sanitizing cycle of the machine. A supply of hotter water at the sanitizing temperature (e.g. 80° F.) is used in the final rinse cycle or sanitizing cycle. To that end, water at a temperature of about 180° to 195° F. is used in the rinse or sanitizing cycle to raise the surface temperature of the dishes, flatware, utensils and other articles being washed to a temperature of at least 160° F. in order to sanitize and to facilitate the air drying of the washed items. In such applications, water which has already been heated by the primary water heater to an elevated temperature such as 140° F. is further heated by a booster heater to increase the water temperature by about 40° F. depending upon the primary water temperature.

For a given booster heater, the water supply rate is inversely related to the required temperature increase. Typically, supply rates range between 80 to 300 gallons per hour (GPH) with a temperature increase of about 40° F. In all cases, it is necessary that the booster heater deliver hot water at the sanitizing temperature and on demand without any significant lag time. In order to reduce the heater size and avoid storage of large amounts of hot water and associated heat losses, it is necessary that the heater start-up time be minimized so that the addition of make-up water does not lower the heater water temperature to below the sanitizing temperature.

In commercial applications such as dishwashing apparatus, there are dimensional restrictions for the booster heater to assure its convenient installation. For example, the heater should be sized for installation below a typical counter height of 36 inches. Further, there must be a minimum 6 inch clearance space above the floor to allow for cleaning. The heater should also be of typical counter depth, in the order of 20 to 25 inches, and have a minimum width.

Electrically heated booster water heaters generally meeting the foregoing requirements are commercially available. However, applicants are not aware of any gas-fired hot water booster heaters meeting the foregoing requirements prior to their invention herein. Atmospheric or powered blue flame gas-fired heaters of considerably larger size for supplying primary water at 140° F. and/or sanitizing water at 180°-195° F. are also known. In some instances, such a blue flame heater may supply all of the water heating requirements and provide both sanitizing temperature water and primary temperature water by mixing with cold water.

U.S. Pat. No. 3,160,145 discloses a gas-fired water heater having atmospheric blue flame gas burners disposed below a horizontally mounted finned tube heat exchanger including upper baffles arranged to cause the combustion products to flow back onto the finned tubes. A similarly arranged water heater which also includes a vertical heat conducting wall for preheating the water is shown in U.S. Pat. No. 4,751,897, but no specific burner is disclosed in this patent. U.S. Pat. Nos. 4,644,904 and 3,242,910 disclose residential hot water heating boilers having finned tube heat exchangers extending horizontally over blue flame burners. U.S. Pat. No. 4,953,511 discloses a fluid or water heater having a centrally mounted infrared burner surrounded by a spirally disposed heat exchanger including a serpentine liquid flow passage. U.S. Pat. No. 4,510,890 discloses a residential hot water heater including a vertical water tank having an infrared burner mounted through its sidewall for connection to a central heat exchange tube which extends upwardly through the tank water.

SUMMARY OF THE INVENTION

In accordance with the present invention, the high energy and temperature characteristics of radiant heating are used to provide a compact gas-fired heater having a rapid start-up time followed by continuous operation at its rated hot water output capacity.

The invention recognizes the special applicability of the radiant combustion phenomenon to the reduction of heater dimensions. More particularly, the invention exploits the use of low-profile burner elements which have little height or thickness as compared to their length and width or area dimensions. Such low-profile elements are especially compatible with radiant heating wherein high energy and temperature flame conditions are achieved with relatively small flame heights and radiant burner combustion surfaces facilitate uniform distribution of heating or energy output.

A compact gas-fired heater is provided by combining an infrared burner and a finned tube heat exchanger containing the fluid to be heated. In order to increase the available heat energy, the infrared burner is provided with a powered source of primary combustion air and a pressurized combustion chamber which cooperate to enable combustion or port loadings of a porous burner combustion surface exceeding those typically used heretofore in such burners. The positive pressure maintained in the combustion chamber also serves to retain the flame on the combustion surface of the burner.

The heat exchanger finned tubes are disposed in close proximity with the burner combustion surface so that the dimensions of the heater are reduced by reason of the comparatively small flame height and required flame clearance of infrared combustion techniques. The close proximity of the burner combustion surface and heat exchanger finned tubes also assure significant convective and radiant heat transfer to the heat exchanger.

The present invention also recognizes that the substantially immediate start-up and hot water supply requirements of booster heaters may be met by combining the high heat energy characteristics of infrared combustion with a finned tube heat exchanger and continuous heater water circulation to protect the finned tubes from the high temperature conditions developed by the burner and to maintain uniform water temperature at 180°-195° F. In such a heater, incoming water at primary temperature is quickly heated to the sanitizing temperature for prompt and continuous heater operation at its rated hot water output capacity without the use of a relatively large water storage tank and associated jacket heat losses. In this manner, the advantages of high energy and high temperature heat transfer are also achieved without the use of high temperature materials in a compact apparatus.

In the illustrated embodiment, the low-profile burner elements comprise six-sided polyhedrons of rectangular box-like configuration with opposed major walls or sides of relatively larger dimensions joined by sidewalls of relatively smaller dimensions. The burner elements are stacked together with their major walls or sides in juxtaposition to reduce the total heater height. The burner assembly has a low-profile configuration wherein the major sides of the burner box, combustion surface, heat exchanger and combustion chamber are substantially coextensive to maximize their space/heating efficiency. In addition to the burner assembly, the low-profile configuration is used in connection with the flue gas vent and combustion air intake elements to both reduce the heater height and to effect preheating of the incoming combustion air. In such arrangements, adjacent walls or sides may be provided in whole or in part by a common wall or common wall portion.

The overall height of the burner assembly is about 6⅝", its width is about 18" and its front to back depth is about 13¾" so that its area or "footprint" is about 247½ in$^2$. If the area or footprint is divided by the height, a profile ratio number of about 37 results. Assuming at least another 3" height for a similarly sized powered blue flame burner, a profile ratio number of about 25 is obtained. In the illustrated embodiment, the heater is substantially contained within a housing having a total height suitable for mounting beneath a typical 36 inch counter height. The housing depth is no greater than the counter depth, and the housing width is less than about 25 inches. The burner box is removably mounted within the housing to enable its removal together with the combustion surface as a unit for service or replacement. To that end, the housing is provided with side and front access openings which permit the burner box to be disassembled from the combustion chamber and withdrawn through the access opening without removal of the heater from its installed position beneath a counter.

BRIEF DESCRIPTION OF THE DRAWINGS

FIG. 2 is a side view partially in section of the heater;

FIG. 3 is a front view partially in section and on an enlarged scale of the infrared burner including its combustion chamber and burner box and showing the interior details and the mounting of the heat exchanger therein;

DETAILED DESCRIPTION OF THE DRAWINGS

Figure 1:
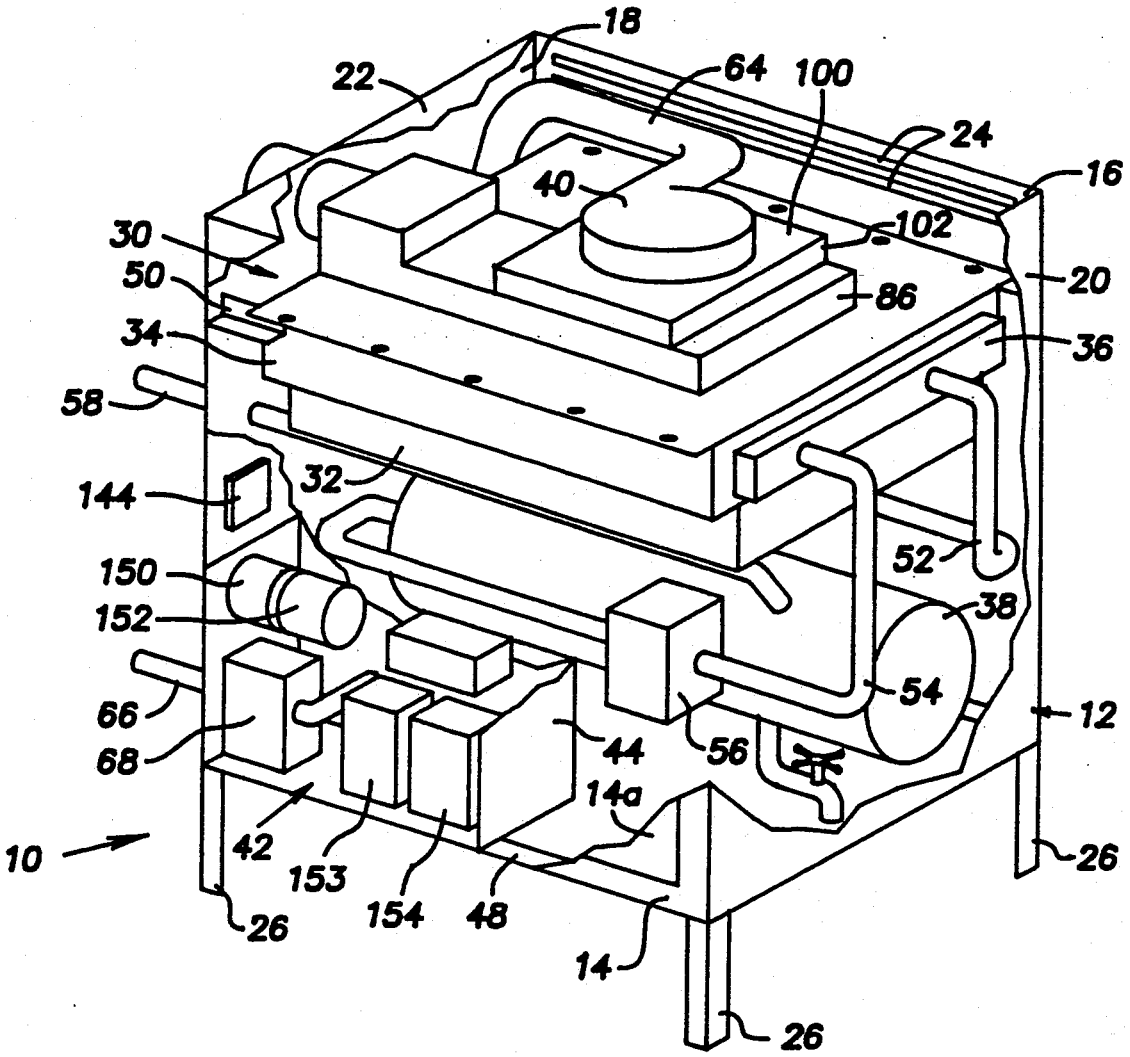
FIG. 1 is a schematic perspective view of a booster water heater including an infrared burner and a finned tube heat exchanger in accordance with the present invention with parts broken away for clarity of illustration.

Referring to FIGS. 1 and 2, a compact booster water heater 10 is enclosed within an outer housing 12 which may be formed of sheet metal. The housing 12 includes front and rear panels 14, 16, left and right side panels 18, 20 and a top panel 22. Front panel 14 has a removable door 14*a* which provides an access opening for repair and service of the heater 10. The panels 14–20 may be provided with louvers 24 for air intake and heat dissipation. The housing 12 is mounted on four corner legs 26 which space the housing about 6 inches from the floor to allow cleaning access. The heater 10 is about 32 ¼" tall, about 25½" wide and has a front to back depth of about 18¼". Accordingly, the heater 10 may be conveniently installed below a standard height counter, for example, the dish tray table or the clean dish table of a commercial dishwashing machine.

The heater 10 includes as its main components an infrared burner or burner assembly 30 comprising a burner box 32 mounted in fluid-tight relationship to a combustion chamber 34, a heat exchanger 36 extending through the combustion chamber 34, a water storage tank 38, a combustion air blower 40 and a control system 42 having its primary elements mounted in an electrical component box 44. The main components of the heater 10 are supported on an interior framework including a lower frame 48 which directly supports the box 44 and tank 38 and an upper frame 50 which supports the burner assembly 30.

A water inlet pipe or line 52 (FIG. 2) is connected to a water supply line which provides hot water under pressure from a central or primary water heater (not shown) at a primary temperature which is nominally 140° F. The water is delivered through line 52 to heat exchanger 36 wherein it is heated to the sanitizing temperature by heat transfer within the combustion chamber 34. The hot water is withdrawn from the heat exchanger 36 via line 54, and an in-line pump 56 is arranged to circulate the hot water to the water tank 38. Hot water is withdrawn from the tank 38 through water outlet line 58 which may be connected, for example, to the feed line to the final rinse manifold of a dishwashing machine (not shown).

If water is not being withdrawn from the heater 10, the hot water is recirculated from the tank 38 through line 60 (FIG. 2) to the water inlet line 52 and then back through the heat exchanger 36. In order to prevent the flow of recycle water into the water supply, a check valve 62 is provided in line 52 downstream from the water supply connection.

The blower 40 provides a flow of primary combustion air in line 64 which is mixed with fuel gas to form a combustible air and fuel gas mixture for delivery to the burner box 32. To that end, the heater 10 includes a fuel gas inlet line 66 which is connected to a supply of fuel gas such as natural gas. The flow of fuel gas is controlled by a combination gas control valve and regulator 68 which delivers the fuel gas via line 70 (FIG. 2) to the heater 10 at the apparatus operating pressure. More particularly, the fuel gas is injected into the line 64 upstream of its connection to the burner box 32.

Figure 4:
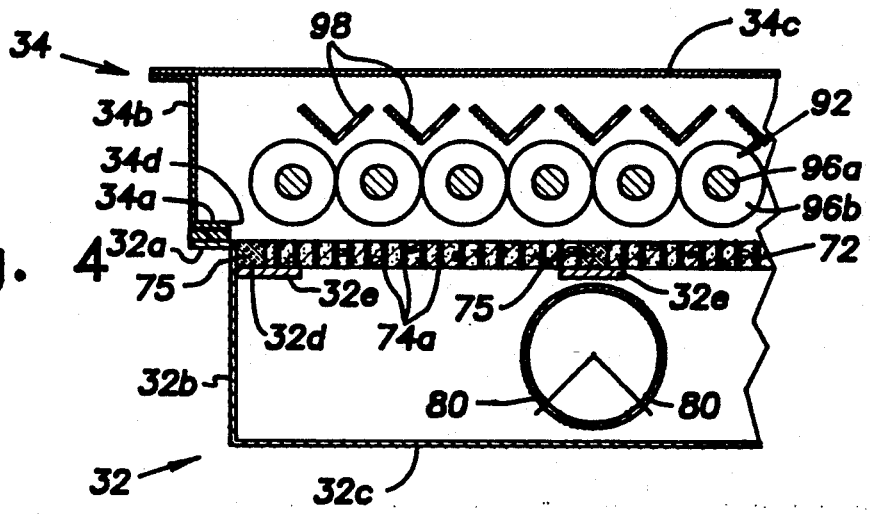
FIG. 4 is a fragmentary sectional view on an enlarged scale showing a portion of the infrared burner box and combustion chamber with the heat exchanger mounted therein.

Referring to FIGS. 3 and 4, the burner box 32 and combustion chamber 34 are separated by a generally planar wall 72 formed of porous ceramic tiles 74 having a plurality of uniformly distributed pores or ports 74a extending through its thickness. The tiles 74 provide a combustion surface 76 on the side of the wall 72 adjacent the combustion chamber 34.

Referring to FIG. 4, the burner box 32 includes a peripheral flange 32a extending laterally from sidewalls 32b which in turn extend to a bottom wall 32c. The flange 32a surrounds an opening 32d in the burner box 32 in which the tiles 74 are mounted to form wall 72. The tiles 74 are supported on lateral supports 32e which extend from the inside surfaces of the sidewalls 32b of the burner box 32. The tiles 74 are fitted with a fluid-tight fit in the opening 32d and are separated from each other by fibrous insulation 75. A suitable fibrous insulation material is sold under the designation Fiberfrax by the Carborundum Company of Niagara Falls, N.Y.

The tiles 74 must be tightly fitted together and the insulation 75 properly aligned in order to assure fluid-tight seals so that the air and fuel gas mixture only passes through pores 74a in the tiles. Preferably, this assembly of tiles 74 and insulation 75 is done in a factory setting to assure that it is correct.

The tiles 74 may be of any suitable size to permit mounting in the opening in the top of the burner box 32. In the illustrated heater 10, four rectangular tiles 74, each being about 5½"×7 7/8", are fitted together to form the wall 72. The tile pores 74a may range from about 0.040 to 0.070 inches in diameter, the tiles 74 have pores of 0.0625 inches in diameter and about 1900 pores per tile. Suitable tiles are commercially available from the Tennaglo Radiant Heat division of Morgan Refractories Limited of Cheshire, England. Alternatively, the wall 72 may comprise a screen of appropriate mesh and porosity which is formed of a suitable metal such as inconel.

The burner box 32 is of generally rectangular configuration, its size being 15¾" wide, 12¼" front to back depth and 3⅛" tall. Accordingly, the burner box 32 has a low-profile and includes major opposed walls or sides provided by the wall 72 formed by the tiles 74 mounted in the opening in the top of the burner box and the bottom wall 32c of the burner box. The metallic components of the burner box 32 may be formed of a mild steel.

A centrally mounted gas distribution pipe 78 having a 2" I.D. extends through the width of the burner box 32 as shown in FIG. 3. Four pairs of ports 80 are evenly spaced along the length of the pipe 78, each port having a ⅝" diameter. The axes of each pair of ports 80 are disposed at a 90° angle with the ports being located at the 135° and 225° positions as best shown in FIG. 4. This arrangement of ports 80 has been found to provide a uniform distribution of the air and fuel gas mixture to the combustion surface 76 for ⅝" and ¾" diameter ports. Alternatively, a larger number of ports having smaller diameters or ports having different configurations may be used.

Figure 5:
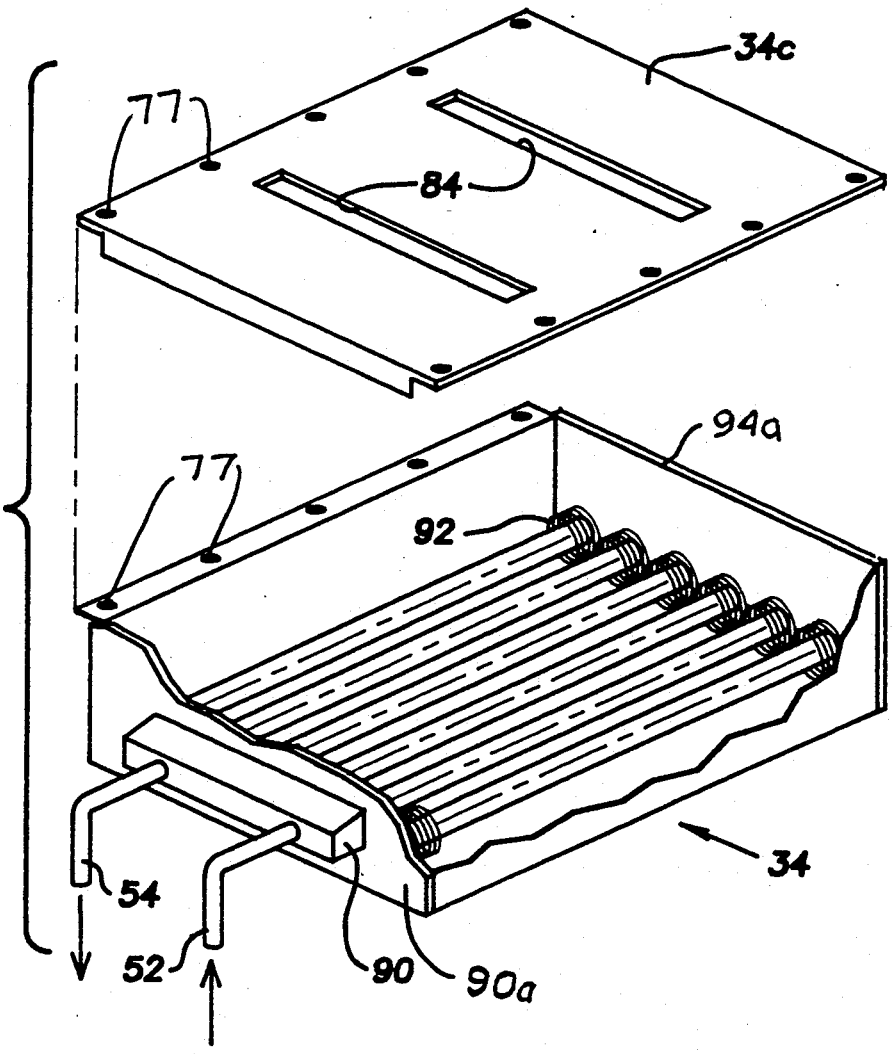
FIG. 5 is a schematic perspective view on an enlarged scale showing the combustion chamber having its top spaced therefrom to expose the heat exchanger.

The combustion chamber 34 includes a lower flange 34a extending laterally inwardly about its lower perimeter and a pair of opposed sidewalls 34b. A top wall 34c is secured to the opposed sidewalls 34b by fasteners (not shown) extending through aligned openings 77 (FIG. 5). The flange 34a surrounds a lower opening 34d which is adjacent the combustion surface 76 when the burner 30 is assembled. The open sides of the chamber 34 are closed by the heat exchanger 36 in the assembled burner 30 as described more fully below.

The combustion chamber 34 is also of a low-profile, rectangular box-like shape, its dimensions being 16" wide, 13¾" front to back depth and 3½" tall. The combustion chamber also has opposed major walls or sides including its top wall 34c and its bottom wall comprising the flange 34a and the opening 34d for the combustion surface 76. The metallic components of the combustion chamber may be formed of a suitable high temperature metal such as 410 stainless steel.

The top wall 34c of the combustion chamber 34 includes two vent slots or openings 84 (FIG. 5) extending therethrough. The slots 84 are 10"×1". As indicated by the arrows "C" (FIG. 3), the combustion products passing through the slots 84 are received within a low-profile vent box 86 overlying the combustion chamber top wall 34c which also provides the bottom wall for the vent box. The vent box 86 is connected to a vent duct 88 extending through the left side panel 18 of the housing 12 as best shown in FIG. 3.

The long dimensions of the slots 84 extend transversely across and substantially perpendicular to the direction of flow of the combustion products through the vent box 86. The slots 84 are centrally located and evenly spaced from the opposed lateral edges of the wall 34c and from each other. Each slot 84 has an area of 10 in.$^2$, and therefore is equal to about 5% of the area of the combustion surface 76 Which has an area of about 180 in.$^2$. The slots 84 are thus positioned and sized to restrict the flow of combustion products and to maintain a positive back pressure in the combustion chamber which causes the combustion and burner flame to be at or near the burner surface 76. The heat exchanger 36 comprises an inlet/outlet header 90 connected by a plurality of finned tubes 92 to a return header 94. Each of the headers 90 and 94 includes an associated mounting wall 90a and 94a which respectively close the open sides of the combustion chamber 34.

In the illustrated embodiment, eight tubes 92 are provided and the headers 90,94 are arranged to cause flow through four of the tubes 92 in each direction across the width of the combustion chamber 34. Inlet water is introduced into header 90 via line 52 and discharged from the heat exchanger via line 54 after flowing through the tubes 92. The water is heated to the desired temperature, e.g., 180°-195° F., in a single pass through the heat exchanger. A suitable heat exchanger is marketed by Raypak Incorporated of Westlake Village, Calif.

The tubes 92 extend through the combustion chamber 34 with a fluid-tight seal. Each tube 92 comprises a 0.631" I.D. copper tube 96a having a wall thickness of 0.042" and seven fins 96b per inch. The fins 96b are integrally formed with the tube 96a. A suitable finned tube is sold by Wolverine Tube of Decatur, Ala. The O.D. of the fins 96b is 1.562". The tubes 92 are mounted on 1.562" centers so that the fins of each tube abut the fins of adjacent tubes. In this manner, the array of tubes is substantially continuous and coextensive with the width and front to back depth of the combustion surface 76.

The plane of the array and of the axes of the tubes 92 is positioned at about the mid-point of the height of the combustion chamber 34. Accordingly, the adjacent extremities of the fins 96b are spaced about one inch or less from the combustion surface 76 and in close proximity with the flame. The flame extends about ⅛" from the surface 76. This positioning of the fins 96b does not interfere with the infrared combustion process, and it enables the overall height of the burner assembly 30 to be about 8" or less while assuring substantial radiative and convective heat transfer. In comparison, a suitably sized atmospheric blue flame combustion process preferably includes about a 6 to 8 inch flame clearance to avoid undue influence on the combustion process, and a powered blue flame combustion process preferably includes a 3 to 4 inch flame clearance.

The convective heat transfer may be further enhanced by the use of baffles 98 arranged to direct combustion products into further contact with the finned tubes 92. Each of the baffles 98 has a V-shape, and they are positioned above the adjacent extremities of the tubes 92 in alignment with the longitudinal tube axes. The heater 10 achieves heating efficiencies in the range of 80%.

The infrared burner is operated with excess combustion air, the primary combustion air ranging from about 110% to about 130% of that required for theoretical complete combustion and stoichiometric balance. Accordingly, the combustion air blower 40 draws ambient air through louvers 24 into a low-profile air intake box 100 having an opening 102. The air intake box 100 overlies the vent box 86, and it is separated therefrom by a common wall 104 (FIG. 3). The incoming air is preheated by the combustion products as the latter are vented via the vent box 86 and vent duct 88 at a temperature just above the condensation temperature of the flue gases.

Figure 6:
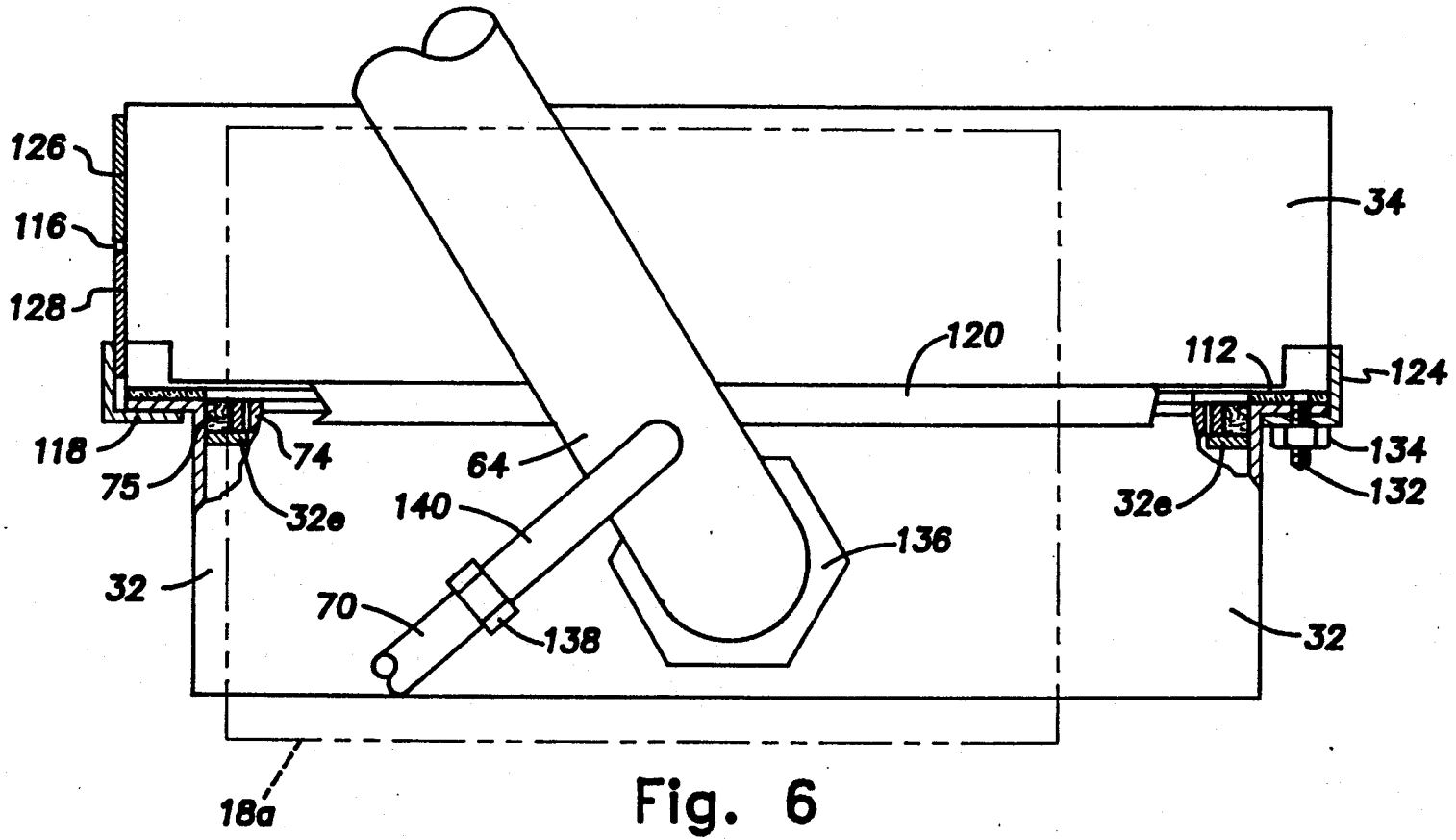
FIG. 6 is an elevational view on an enlarged scale showing the details of the mounting of the burner box to the combustion chamber with parts omitted for clarity of illustration.
Figure 7:
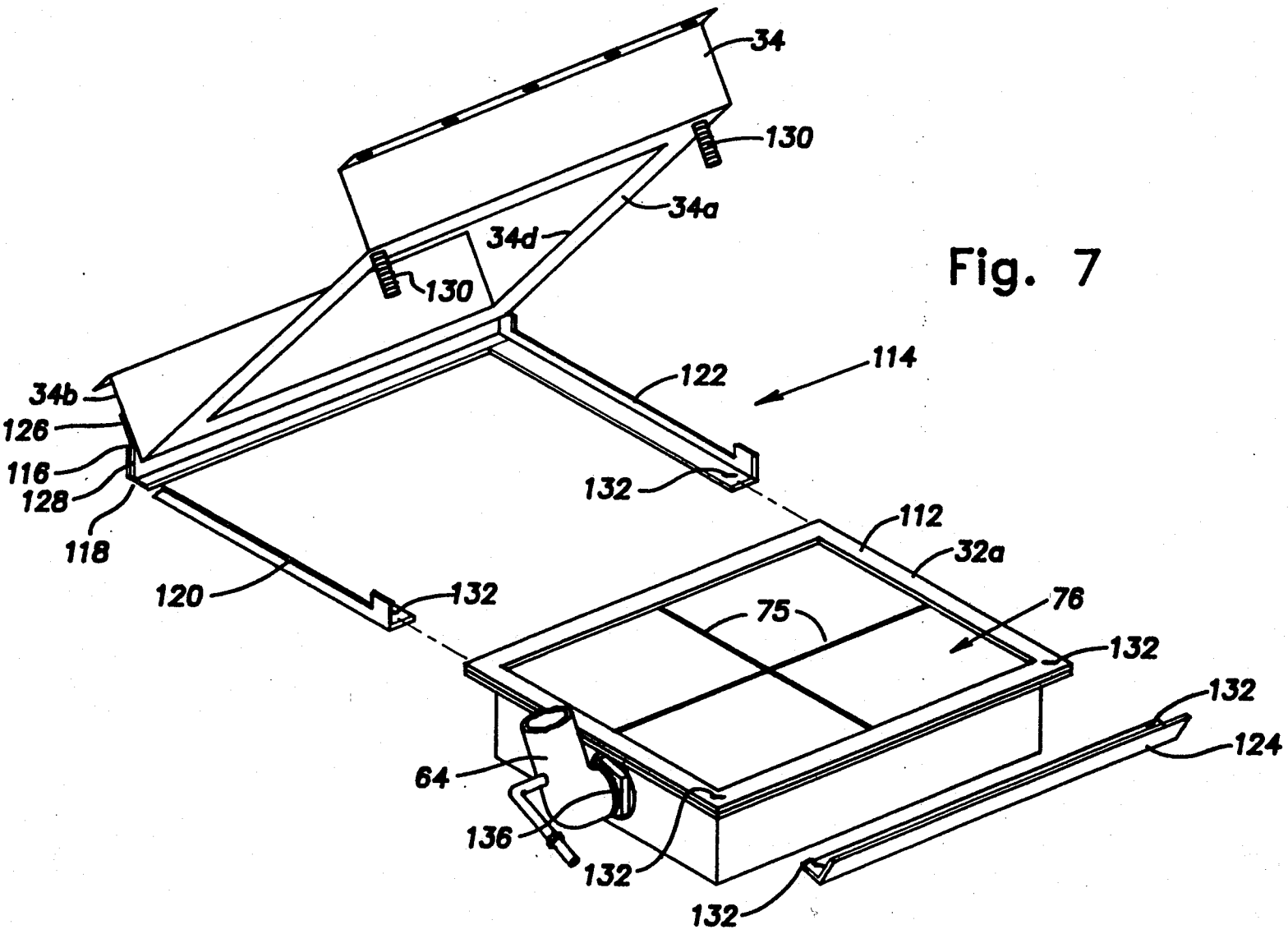
FIG. 7 is a schematic, exploded perspective view on an enlarged scale showing the burner box disassembled from the combustion chamber with parts omitted for clarity of illustration.

The burner box 32 is detachably mounted to the combustion chamber 34 to enable the former to be removed for replacement or on-site service. As shown in FIGS. 6 and 7, the combustion chamber flange **34*a* and the burner box flange 32*a* are joined in a fluid-tight seal by means of a gasket 112 formed of a fibrous insulating material such as the above mentioned Fiberfrax material. More particularly, the flange 32*a* of the burner box 32 is mounted within a mounting bracket 114 secured to the rear sidewall 34*b* of the combustion chamber 34 by a hinge 116. The bracket 114 is an open framework comprising a rear support member 118, a pair of opposed side support members 120 and 122 rigidly extending from associated ends of the rear member 118, and a detachable front support member 124. Each of the members 118, 120, 122 and 124** is made of metal formed to have a right angle cross-section.

The hinge 116 includes first and second leafs 126 and 128 secured between the rear sidewall **34*b* of the burner box 34 and the bracket 114. The hinge leaf 126 is fixed to the rear sidewall 34*b* in any convenient manner such as by welding and the leaf 128 is similarly fixed to the rear support member 118 of the bracket 114. As shown, a stud 130 projects downwardly from each front corner of the flange 34*a*. The studs 130 are received in associated clearance bores 132 in the support members 120, 122 and 124. A similar pair of clearance bores 132 are provided in the front corners of the flange 32*a* of the burner box 32. When the burner box 32 is mounted to the combustion chamber 34, the studs 130 extend through the clearance bores 132 for engagement with threaded fasteners 134**.

The burner box 32 may be removed from the heater 10 by disconnecting the combustion air line 64 at union 136. The gas line 70 may be similarly disconnected from the air line 64 at threaded connector 138 which connects the gas line 70 to a gas injector nozzle 140. These parts may be disconnected by manipulation of hand tools through an access opening **18*a* (shown in phantom outline in FIGS. 2 and 6) in side wall panel 18 of the housing 12 without removing the heater 10 from its installed position below a counter. Similarly, front door 14*a* (FIG. 1) of the housing 12 may be removed to provide a suitably sized access opening for removal of the burner box 32. More particularly, upon disconnecting the fasteners 134, the front support member 124 may be removed and the remaining members of the bracket 114 may be swung downwardly on the hinge 116 to an open position to enable removal of the burner box 32 by movement thereof through the access opening in the front panel 14 of the heater 10. In this manner, the burner box 32 may be replaced as a unit. This is advantageous since the ceramic tiles 74 must be properly seated and sealed, and a factory assembled burner box including a correctly sealed combustion surface 76** may be substituted at an installation site with a reduced risk of improper in-field service.

A new or repaired burner box 32 is remounted to the combustion chamber 34 by inserting it into position with the associated side portions of the flange **32*a* overlying the laterally extending legs of the support members 120 and 122. Upon complete insertion, the rear and side portions of the flange 32*a* overlie the lateral legs of the support members 118, 120 and 122. The bracket 114 is then pivoted about the hinge 116 and moved upwardly to its closed position with the studs 130 extending through the clearance bores 132 and 32*b*. This assembly sequence is advantageous since the gasket 112 is only compressed through its thickness after it is fully positioned in bracket 114, and it is not subject to tearing by sliding movement in a compressed condition. Similarly, the front support member 124 is positioned under its associated portion of the flange 32*a* with the studs 130 extended through the bores 132 for engagement with the fasteners 134. Upon replacement of the burner box, the combustion air line 64 and fuel gas line 70 may be reconnected and operation of the heater 10** continued with a minimum of downtime.

As described above, the burner box 32 is easily removable and replaceable without disconnecting threaded joints of the fuel supply system other than those of a union type. Further, this may be done without the use of special tools. Accordingly, ANSI burner standard Z21.10.3, 1990, Section 1.6.2 is fully met.

The control system 42 includes the necessary logic circuits for automatic and thermostatic control of the heater 10 in known manner. The major components of the control system 42 are contained in the electrical component box 44 mounted in the lower front corner of the housing 12 as best shown in FIG. 1. A control circuit board 144 receives various operating and safety shut down signals. For example, the operating heater water temperature signal is sensed by a thermistor 146 (FIG. 3) mounted in the outlet portion of the header 90 of the heat exchanger 36. Safety controls arranged to shut down the heater 10 upon sensing improper operation include a water temperature over heat thermostat 148 (FIG. 3) mounted in the outlet portion of the header 90, blower air micro pressure switch 150 (FIG. 1) arranged to confirm proper air pressure in the line 64 operation of the blower 40, and flue air micro pressure switch 152 (FIG. 1) arranged to confirm proper static pressure in the vent duct 88. The control system 42 also includes a relay 153 (FIG. 1) to control the start-up of pump 56 and blower 40 which are arranged to run continuously during heater operation as discussed below.

At start-up, the relay 152 causes the pump 56 and the blower 40 to operate. The pump 56 assures that water is continuously circulating through the heat exchanger 36 and finned tubes 92 since the latter would be damaged if the burner assembly 30 were operated without circulation of water to remove heat from the heat exchanger. In order to evacuate any excess or accumulated fuel gas, the blower 40 operates continuously to assure that at least four volumes of air are purged from the burner box 32, the combustion chamber 34 and the vent box 86 prior to ignition. Thereafter, the ignition control 154 causes ignitor and flame sensor 156 (FIG. 3) to heat to ignition temperature in a two to three second time frame to in turn permit fuel gas flow through the regulator 68 and fuel delivery line 70. The ignitor and flame sensor 156 also confirms ignition by sensing the presence of a flame in the combustion chamber 34.

During standby operation of the heater 10, the pump 56 continuously operates and circulates water through the tank 38, the recirculation water line 60, the water inlet line 52, the heat exchanger 36 and then back to the tank 38 through line 54. The blower 40 also continuously operates during heater operation in order to minimize heater start-up time. Any temperature decrease below the set temperature of 180° F. due to jacket heat loss is sensed by thermistor 146 mounted in the outlet portion of the header 90 (FIG. 3). The thermistor 146 sends a low temperature signal to the control board 144 to cause a short burner operation cycle. Upon reaching the operating temperature, the burner operation is stopped.

If hot water is drawn from the heater 10 through outlet line 58, the check valve 62 immediately opens to permit the flow of replacement water at a temperature of 140° F. into the heater 10. The replacement water reduces the temperature of the water at the outlet portion of the header 90 and the thermistor 146 responds with a low temperature signal to the control board 144. The ignition sequence begins and burner operation is achieved in less than 17 seconds to assure that the temperature of the water in the tank 38 remains at 180°-195° F. and that a continuous supply of 180° F. water is provided. This assures that the temperature of the 3.5 gallons of water in the tank 38 is not reduced below the sanitizing temperature due to the input of 140° F. water upon draw of water from the heater 10.

The energy input to the heater 10 may range from about 105,000 to 160,000 BTU/hr. in accordance with the heater application and the combustion characteristics. The corresponding combustion loadings of the burner surface 76 range upwardly from about 550 BTU/hr. in.$^2$ or higher since lower loadings are susceptible to flash back. The maximum combustion loading is about 900 BTU/hr. in.$^2$ since higher loadings tend to result in flame lift-off from the combustion surface. Preferably, the combustion loading is about 700 BTU/hr. in.$^2$ or slightly higher. In the illustrated embodiment, the combustion loading is about 750 BTU/hr. in.$^2$ and the rated heater input is 130,000 BTU/hr. In prior powered radiant burners having similar combustion surfaces, the combustion loadings are generally in the range of 350 to 425 BTU/hr. in.$^2$. The combustion temperature at the surface 76 may be in the range of from 1800° to 2000° F., and preferably, in the range of from about 1800° to 1950° F. In the illustrated embodiment, the ceramic tiles 74 are rated for temperatures up to 2300° F.

We claim:

1. A gas-fired booster water heater for heating water to a temperature of about 180° F. for use in a sanitizing cycle of high-temperature commercial dishwashing or warewashing machines, said heater including an outer housing sized to be installed beneath a counter and containing burner means including a burner box and a combustion chamber separated by an infrared burner combustion surface facing into the combustion chamber, a heat exchanger assembly including finned tubes disposed in said combustion chamber for circulation therethrough of water to be heated, fuel supply means for supplying a combustible gaseous mixture of air and fuel gas to said burner box for combustion within said combustion chamber at or near said combustion surface and with the formation of hot flue gases, said finned tubes being arranged to provide multiple passes across the combustion surface in close proximity thereto with the hot flue gases flowing over the finned tubes whereby said combustion surface provides both radiant and convective heat transfer to said heat exchanger and circulating water therein, said flue gases being vented from said combustion chamber through a restricted vent opening means for imposing a positive pressure on the combustion surface to retain combustion at or near the combustion surface.

2. A heater as in claim 1, wherein said combustion chamber has a wall opposed from said combustion surface and substantially coextensive therewith, and said restricted vent opening means include centrally located and uniformly spaced openings through said opposed wall.

3. A heater as in claim 2, wherein said vent opening means also include a vent box in fluid communication with said openings for continued flow of flue gases therethrough, and said openings include at least a pair of elongate openings having their long dimensions extending transverse to the direction of continued flow of the flue gases through said vent box.

4. A heater as in claim 1, wherein said heater includes combustion air supply means including a blower for providing all of the primary combustion air, said combustion air supply means including a surface providing a heat exchange relationship between said hot flue gases and said primary combustion air causing said primary combustion air to be heated before entering said combustion chamber thereby improving the thermal efficiency of said heater and reducing the temperature of said flue gases leaving said heater.

5. A heater as in claim 4, wherein said combustion surface loading is in the range of from about 550 to 900 BTU/in$^2$ hr.

6. A heater as in claim 5, wherein said combustion surface loading is greater than about 700 BTU/in$^2$ hr and said combustion surface has an area equal to about 180 in$^2$.

7. A heater as in claim 5, wherein said finned tubes are spaced less than about 3 inches from said combustion surface.

8. A heater as in claim 7, wherein said burner box and combustion chamber have a combined dimension in a direction perpendicular to said combustion surface of less than about 8 inches.

9. A heater as in claim 8, wherein said burner box and combustion chamber each have a low-profile, rectangular box-like configuration with opposed major sides extending in planes substantially parallel with the combustion surface.

10. A heater as in claim 9, wherein said finned tubes are aligned in a plane disposed in substantially parallel relationship with said combustion surface.

11. A heater as in claim 10, wherein said finned tubes are disposed in substantially abutting relationship in a pattern which is substantially coextensive with said combustion surface.

12. A heater as in claim 11, wherein said heater also includes a low-profile vent box disposed over said vent opening means to receive said flue gases, and a low-profile air intake box connected to said blower for incoming air flow is disposed over said vent box remote from said combustion chamber.

13. A heater as in claim 1, wherein said heater also includes a vent box for venting flue gases from said combustion chamber, and an air intake box connected to said blower, and said burner box, combustion chamber, vent box and air intake box each have a low-profile, rectangular box-like configuration with opposed major sides and are arranged in a stacked configuration with adjacent major sides disposed in juxtaposition.

14. A heater as in claim 1, wherein said combustion surface has a combustion temperature in the range of 1800° to 2000° F. and said heater also includes a tank for holding heated water and pump means continuously circulating the water from the finned tubes of the heat exchanger assembly to the tank and back to the heat exchanger to thereby prevent damage to the finned tubes due to the combustion temperature of said combustion surface.

15. A heater as in claim 1, wherein said housing includes an access opening, said burner box is detachably mounted to said combustion chamber by fastener means manipulatable by hand or with hand tools, and said burner means includes bracket means movable between open and closed positions by manipulation of said fastener means for mounting and removing said burner box together with said combustion surface as a unit through said access opening without removal of said heater from said installed position under the counter.

16. A gas-fired booster water heater for heating water to temperatures of about 180° F. for use in a high-temperature cycle of commercial washing apparatus comprising a heat exchanger assembly for circulating water to be heated therethrough, and an infrared burner means for convective and radiant heat transfer to said heat exchanger assembly for heating the water therein, fuel supply means for supplying a combustible gaseous mixture of air and fuel gas to said burner means, said burner means including a burner box having a porous combustion surface disposed adjacent said heat exchanger assembly for combusting said gaseous mixture at or near said combustion surface with the formation of hot flue gases, said heat exchanger assembly including a plurality of tubes containing the circulating water and disposed in close proximity to said combustion surface with the hot flue gases flowing over the tubes whereby said burner means provides both radiant and convective heat transfer to said heat exchanger and circulating water therein, said burner means including a burner box and a combustion chamber each having a low profile and a box-like configuration with opposed first and second major walls extending in plane substantially parallel with said combustion surface, said burner box first major wall including said combustion surface, and said combustion chamber first major wall including an opening adapted to be adjacent said combustion surface when said burner box and combustion chamber are mounted together in an assembly, said combustion chamber providing a second major wall substantially co-extensive with said combustion surface and including at least two uniformly spaced and centrally located elongated rectangular-shaped openings for restricting the venting of hot flue gases.

17. A heater as in claim 16, wherein said burner means includes a combustion chamber to which said burner box is mounted with said combustion surface facing into said combustion chamber, said heat exchanger includes tubes extending through said combustion chamber in close proximity with said combustion surface.

18. A heater as in claim 16, wherein said burner box includes a flange laterally extending about the periphery of said burner box first major wall and combustion surface, said combustion chamber includes an associated flange laterally extending about said opening in its first major wall, and said burner box and combustion chamber are removably mounted together by detachably fastening said flanges together in a fluid-tight seal.

19. A heater as in claim 16, wherein said heater also includes a low-profile vent box having opposed first and second major walls, said vent box first major wall being provided by said combustion chamber second major wall, said flue gases flowing from said combustion chamber through said elongate openings into said vent box for continued flow to discharge.

20. A heater as in claim 19, wherein said heater also includes a low-profile air intake box having opposed first and second major walls, said air intake box first major wall being provided by said vent box second major wall whereby incoming air is preheated by said flue gases flowing in said vent box.

21. A heater as in claim 16, wherein said heater also includes a water tank for storing heated water, pump means for continuously circulating water through said heat exchanger and water tank during operation of the heater to thereby prevent damage to the heat exchanger tubes due to the high temperatures associated with said combustion surface.

22. A heater as in claim 21, wherein said heat exchanger tubes are finned tubes having aligned longitudinal axes and are disposed in substantially abutting relationship in a plane which is parallel with the combustion surface.

23. A heater as in claim 22, wherein said heater includes an outer housing sized to be installed beneath a 36 inch high counter.

24. A gas-fired booster water heater for heating water to a temperature of about 180° F. for use in a sanitizing cycle of high-temperature commercial dishwashing or warewashing machines comprising a housing adapted to be installed under a counter and containing burner means including a burner box and a combustion chamber separated by an infrared burner combustion surface facing into the combustion chamber for combusting an air and fuel gas mixture within the combustion chamber at or near said combustion surface, said housing including an access opening for removal of said burner box, and a heat exchanger assembly including finned tubes disposed in said combustion chamber for circulation therethrough of water to be heated, said burner means including bracket means movable between open and closed positions for mounting and removing said burner box together with said combustion surface as a unit through said access opening without removal of said heater from said installed position under the counter.

25. A heater as in claim 24, wherein said bracket means is movable between said open and closed positions by manipulation of hand tools through said access opening.

26. A heater as in claim 25, wherein said bracket means comprises a framework pivotally mounted to said combustion chamber, said framework being movable between an open position for receiving said burner box and a closed position for mounting said burner box to said combustion chamber with a fluid-tight seal.

27. A heater as in claim 26, wherein said framework comprises a rectangular frame of metal elements to receive said burner box, said frame including a rear support member pivotally connected to said combustion chamber, a pair of opposed side support members fixed to said rear support member, and a removable front support member, said support members being adapted to fully engage said burner box and to pivotally move with the engaged box to a closed position to mount said burner box to said combustion chamber.

28. A heater as in claim 27, wherein said burner box includes a lateral flange extending about its periphery for engagement by said frame.

* * * * *